US005330082A

United States Patent [19]

Forsyth

[11] Patent Number: 5,330,082

[45] Date of Patent: Jul. 19, 1994

[54] THREADED DISPENSING CLOSURE WITH FLAP

[75] Inventor: Michael J. Forsyth, Stow, Ohio

[73] Assignee: Weatherchem Corporation, Twinburg, Ohio

[21] Appl. No.: 997,650

[22] Filed: Dec. 28, 1992

Related U.S. Application Data

[63] Continuation of Ser. No. 734,204, Jul. 22, 1991, abandoned.

[51] Int. Cl.[5] ..... B67D 3/00

[52] U.S. Cl. ..... 222/480; 222/482; 222/556; 222/498

[58] Field of Search ..... 220/254; 222/153, 480, 222/485, 482, 556, 565, 498, 517, 545

[56] References Cited

U.S. PATENT DOCUMENTS

| | | | |
|---|---|---|---|
| D. 265,060 | 6/1982 | Blank | D9/446 |
| D. 276,981 | 1/1985 | Clevely | D9/449 |
| D. 292,882 | 11/1987 | Gross | D9/435 |
| D. 306,701 | 3/1990 | Beck | D9/446 |
| 278,602 | 4/1885 | Rosenstein | D9/449 |
| 3,059,816 | 12/1962 | Goldstein | 222/109 |
| 3,351,242 | 11/1967 | Lodding et al. | 222/485 X |
| 3,933,271 | 1/1976 | McGhie | 222/556 X |
| 4,127,221 | 11/1978 | Vere | 222/153 |
| 4,236,653 | 12/1980 | Gach | 222/153 |
| 4,284,200 | 8/1981 | Bush et al. | 222/545 X |
| 4,334,639 | 6/1982 | Gach | 222/153 |
| 4,359,171 | 11/1982 | Lewis | 222/565 X |
| 4,369,901 | 1/1983 | Hidding | 222/480 |
| 4,494,679 | 1/1985 | Cleevely | 222/151 |
| 4,533,058 | 8/1985 | Uhlig | 222/153 X |
| 4,580,687 | 4/1986 | Lewis | 215/237 |
| 4,693,399 | 9/1987 | Hickman et al. | 222/480 |
| 4,714,181 | 12/1987 | Kozlowski et al. | 222/480 |
| 4,838,441 | 6/1989 | Chernack | 222/153 X |
| 4,881,668 | 11/1989 | Kitterman et al. | 222/482 |
| 4,898,292 | 2/1990 | VerWeyst et al. | 215/237 |
| 4,915,268 | 4/1990 | Lay et al. | 222/566 X |
| 4,919,286 | 4/1990 | Agbay, Sr. | 215/235 |
| 4,936,494 | 6/1990 | Weidman | 222/480 |
| 5,048,730 | 9/1991 | Forsyth et al. | 222/482 |

FOREIGN PATENT DOCUMENTS

| | | | |
|---|---|---|---|
| 1084025 | 9/1967 | United Kingdom | 222/565 |

OTHER PUBLICATIONS

Vero Ricci 1987 Drawing of cap.

*Primary Examiner*—Andres Kashnikow
*Assistant Examiner*—Kenneth Bomberg
*Attorney, Agent, or Firm*—Pearne, Gordon, McCoy & Granger

[57] ABSTRACT

A screw-on flap-style dispensing cap having a snap catch for releasably holding the flap in its closed position. The snap catch and supporting cap body and flap areas are configured to increase the retaining force produced by the snap catch when the cap is locally deformed as the cap is applied to a container mouth with a relatively high torque level so that a tendency of the flap to pop open when over-tightened is compensated.

10 Claims, 2 Drawing Sheets

THREADED DISPENSING CLOSURE WITH FLAP

This is a continuation of application Ser. No. 07/734,204, filed Jul. 22, 1991, now abandoned.

BACKGROUND OF THE INVENTION

The invention relates to dispensing closures for bottles, jars and the like and, more particularly, to such closures having a secondary closure in the form of a reclosable flap.

PRIOR ART

Des. U.S. Patent Nos. 278,602, 4,693,399, 4,714,181, 4,898,292 and 4,936,494 illustrate examples of a type of dispensing closure in the form of a screw-on cap with a snap closed flap. The flap is used to selectively open and close one or more dispensing apertures for granular or particulate materials such as spices as well as other food products and non-food products. Certain of these types of closures have met with a high degree of success in the market place. A problem encountered with this general type of closure has been its sensitivity to excessive tightening forces when screwed onto a bottle. If a cap is over-tightened by an improperly operating automatic capping machine, the cap may be distorted and a flap may tend to snap open from its closed position. Opening of the flaps in the capping process creates a serious obstacle to the automatic handling of the capped bottles. Also troubling are over-tightened caps that snap open in transit or handling and, if displayed for sale without being reclosed, give the appearance that they have been subject to tampering.

In general, prior attempts to make a cap with flaps that stay closed under severe cap tightening forces have often resulted in increased opening force requirements. This is a serious disadvantage because of the difficulty a user may experience in attempting to manually open a flap. Difficulty in opening a flap can result, for example, in the user breaking a fingernail.

SUMMARY OF THE INVENTION

The present invention provides a screw-on flapped dispensing cap that resists accidental flap opening when over-tightened in a capping machine. The invention has flap snap or catch elements that tend to increase their coupling force in proportion to the degree of over-tightening imposed on the cap. As disclosed, the invention has the flap catch elements disposed where deformation due to tightening of the cap on a bottle mouth tends to increase the stability of the coupling action between the catch elements.

More particularly, in the disclosed embodiment, the cap body is configured so that axial deflection due to tightening of the cap is converted to radially outward deflection of an associated catch supporting area. The radially outward catch movement increases the retention force on the cooperating catch area of the flap. The radially outward movement of the catch area tends to put the flap in tension so that the risk of flap buckling and consequent unwanted release of the flap is reduced.

A secondary benefit of the invention is the reduction of any increased retention force due to over-tightening when the cap is first unscrewed by the user from the bottle to remove a tamper-evidencing and freshness liner applied to the mouth of the bottle before the cap is first installed. Frequently, the user, before attempting to open a flap or flaps, can unscrew the cap to remove the liner. Typically, the user will reapply the cap with less tightening force than could be applied with automatic capping equipment. Consequently, the flap opening force once the cap is re-screwed onto a bottle is relatively low and conveniently manually overcome.

DESCRIPTION OF THE PREFERRED EMBODIMENT

Figure 1:
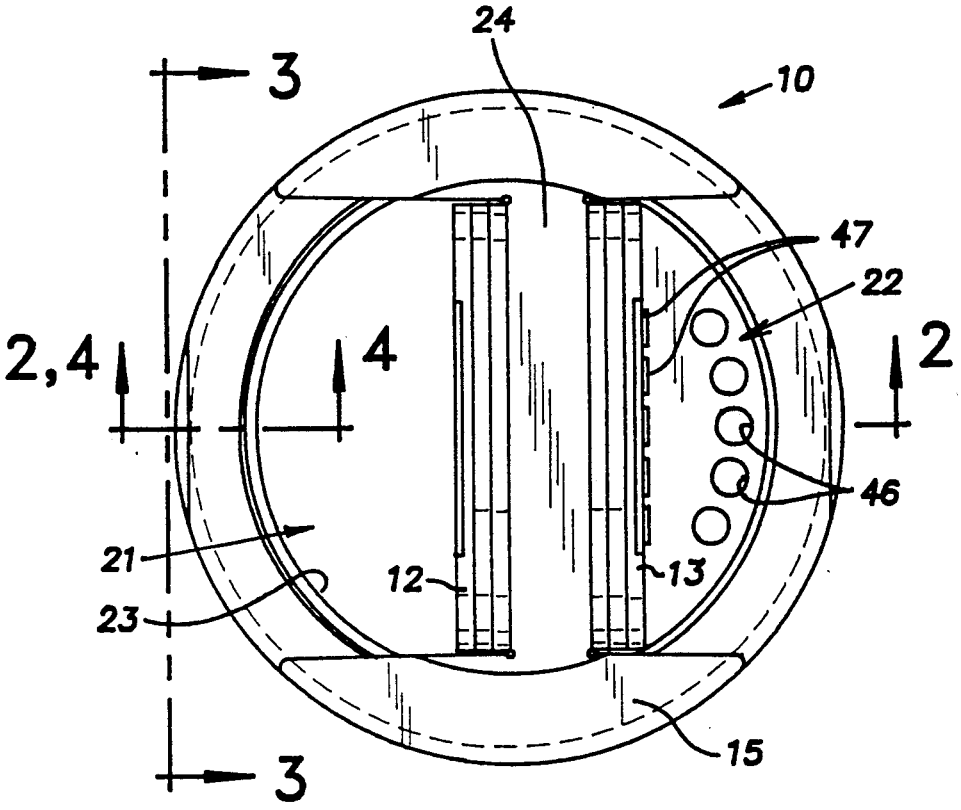
FIG. 1 is a plan view of a cap embodying the invention shown with its flaps open.

A cap 10 constructed in accordance with the invention comprises a unitary injection molded part of thermoplastic material such as polypropylene. The illustrated cap 10 has a body or base 11 and two oppositely disposed flaps 12 and 13. The cap 10 has the general appearance of a short cylindrical body when its flaps 12, 13 are closed. The cap body 11 is circular in plan view and includes a cylindrical tubular skirt 14 and a generally circular end wall 15. Internal screw threads 18 on the inside of the skirt 14 mate with external threads on the neck of a container, bottle, jar or the like (not shown) in a generally conventional manner for mounting the cap 10 in a screw-on manner to the container and thereby closing its mouth.

The circular end wall 15 extends radially inwardly from the skirt 14 forming a circumferentially continuous sealing surface or ledge 19 preferably lying in a flat radial plane. The end wall is divided into spoon and shake sections 21, 22, respectively, each having an associated one of the flaps 12, 13. The illustrated cap 10 is a 48 mm size (diameter); the thicknesses of the skirt 14, end wall 15 and flaps 12, 13 are generally the same, being, for example, about 0.050 inch. The spoon section 21 of the end wall has a D-shaped aperture 23 surrounded on its curved edge by a segment of the ledge 19.

Figure 4:
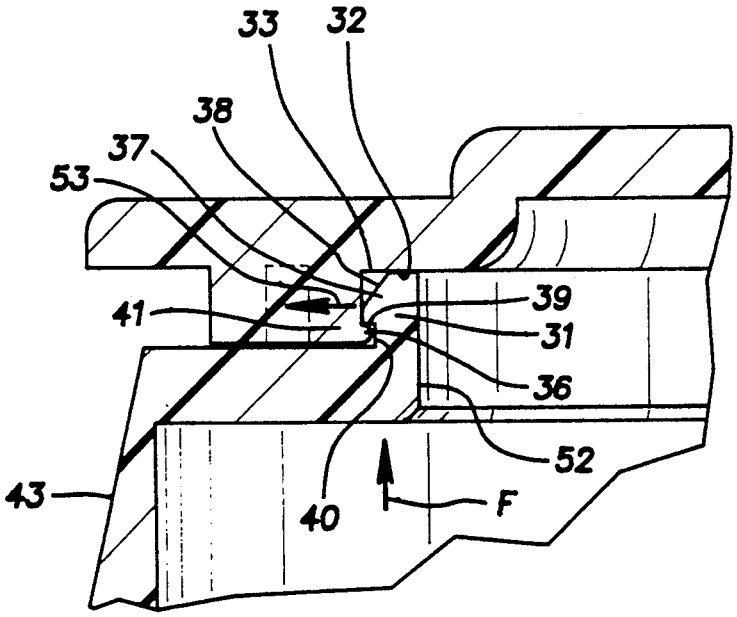
FIG. 4 is an enlarged fragmentary cross-sectional view taken in the plane 4—4 indicated in FIG. 1 and shown with the associated flap in its closed position.

The spoon flap 12 is integrally joined to a chordal section 24 of the end wall 15 by a living hinge 26. The hinge 26 is formed of a relatively thin wall section extending in a straight line across a fixed edge of the flap 12. A curved portion of a free edge 27 of the flap 12 has a radius generally equal to the outside diameter of the skirt 14. The spoon flap 12, when closed, prevents passage of the contents of the container. In the illustrated embodiment, the spoon flap 12 in its closed position rests against an axially extending flange wall 31 adjacent the radial inner edge of the ledge or sealing surface 19. With reference to FIG. 4, the sealing or closure between the flap 12 and end wall 15 occurs between a generally radial surface area 32 on the underside of the flap 12 and an upper radial face 33 of the flange wall 31.

The spoon flap 12 is retained in the closed position by catch elements 36, 37 in the form of interengaging projections on the flap 12 and on the end wall flange 31, respectively. In the illustrated embodiment, the flange catch 37, having the cross-section illustrated in FIG. 4, is substantially coextensive with the arc of the flange 31.

The catch 37 is formed by surfaces on the flange 31 that face generally radially outwardly and include a conical or tapered area 38 with increasing radius in an axially downward direction and an undercut zone with a radial portion 39 and a cylindrical portion 40.

The catch element 36 on the flap 12 is formed as discreet segments at angularly spaced locations on an axially depending flange 41 spaced radially inwardly from the free edge 27 of the flap and arcuately generally coextensive with this edge. At each location, a catch segment 36 is formed by a radially inwardly facing rib of semi-circular cross-section as indicated in FIG. 4.

When the flap 12 is pressed towards the closed position, the tapered surface 38 of the body flange catch 37 acts as a cam surface to draw the flap catch element segments 36 first radially outwardly and then allow such segments to snap into the undercut formed by the surface portions 39, 40. In this condition, the catch elements 36, 37 are interengaged to releasably retain the flap 12 in its closed position. The flap 12 is opened by gripping the underside of its edge in the area of a relief 43 formed in the outer surface of the skirt 14 and overcoming the grip of the flap catch element 36 in the undercut of the catch 37.

Figure 5:
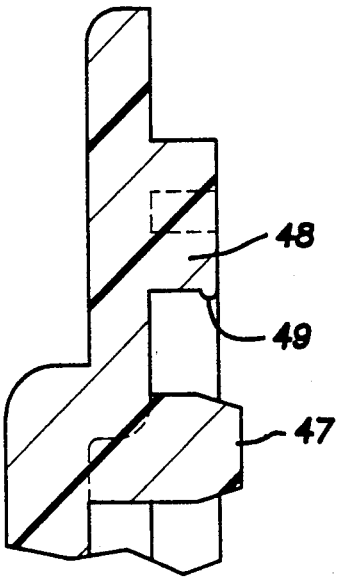
FIG. 5 is an enlarged fragmentary cross-sectional view of a portion of a flap for a shake side of the cap.

On the shake section 22, the end wall 15 has a series of relatively small apertures 46 therethrough for dispensing product in a shake or sift mode with the associated flap 13 open. The flap 13 has a plurality of plugs 47 that register into the apertures or holes 46 when the flap 13 is closed. The flap 13 includes a depending flange 48 with a catch 49 (FIG. 5) in a manner analogous to the catch element segments 36 on the spoon flap 12 to releasably maintain the flap 13 in a closed position by engaging an undercut or catch 51 (FIG. 2) on the shake section 22.

A potential problem exists where a flap style cap is applied to a container in an automatic capping machine and such equipment is improperly adjusted so that excessive torque is applied to the cap. Screw-on flap-type dispenser caps are prone to distort because of excessive capping torque and tend to release the flaps from their closed positions either during poorly controlled capping operations or during subsequent handling. Typically, distortion in a cap can exert a force that lifts a flap away from the areas at which it is retained in its closed position. When the cap 10 is forcibly screwed onto the threaded neck of a container, the sealing surface 19 tightly engages the mouth of the container or a liner interposed between it and the mouth of the container. The illustrated cap 10 of the invention utilizes the distortion of the cap wall areas forming the sealing surface 19 due to excessive torque to produce a deflection of the catch 37 that compensates for internal cap forces tending to pop open the associated flap and prevent the net external force required to open the flap from substantially decreasing or being eliminated altogether with an attendant instability of flap closure.

With reference to FIG. 4, the mechanism of the compensating action can be understood from the following simplified analysis. The pressure of the rim or mouth of a jar or bottle on which the cap 10 is tightened is represented by the arrow F. This axially upwardly directed force F causes an upward bending deflection of the end wall 15 overlying the sealing surfaces 19 analogous to the bending of a cantilever beam. This deflection has a rotational component in the end wall 15 (counter-clockwise in FIG. 4) since the skirt 14 and junction of the wall with the skirt can be assumed to be fixed to the container neck, i.e. stationary, while a radially inner edge 52 of this wall moves axially upwardly. As a consequence of this rotation-like deflection, the axial flange 31 and, in particular, the catch 37 moves radially outwardly as indicated by the arrow 53. This radially outward component of movement of the catch 37 tends to increase the retaining force it applies to the flap 12. The radially outward force applied by the flange hook or catch 37 operates to put the main part of the flap in tension to produce a stable closed state. This effect avoids the potential for the flap 12 to pop open.

Figure 2:
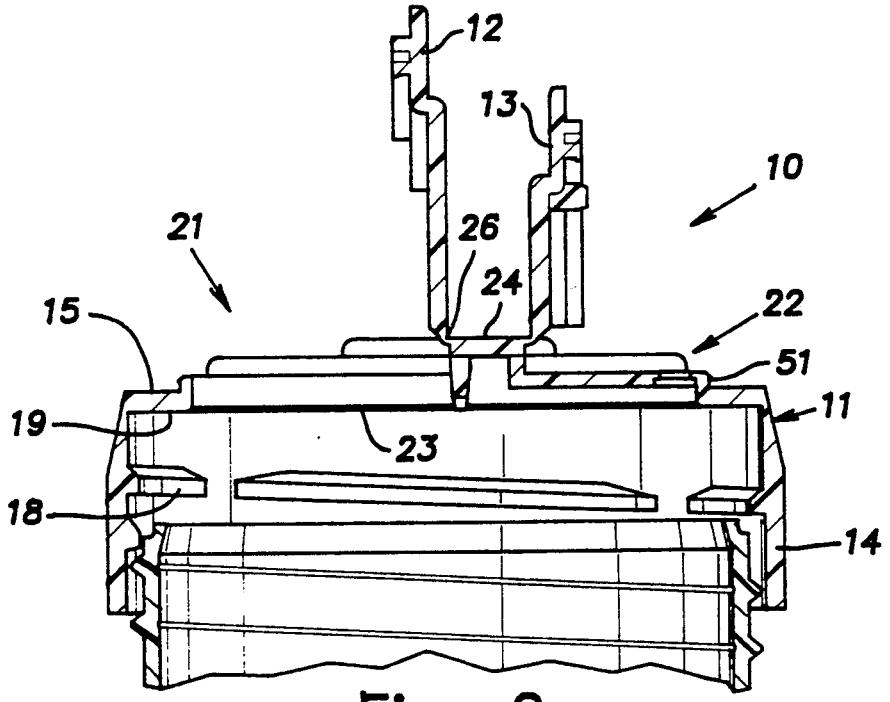
FIG. 2 is a cross-sectional elevational view of the cap taken in the plane 2—2 indicated in FIG. 1.
Figure 3:
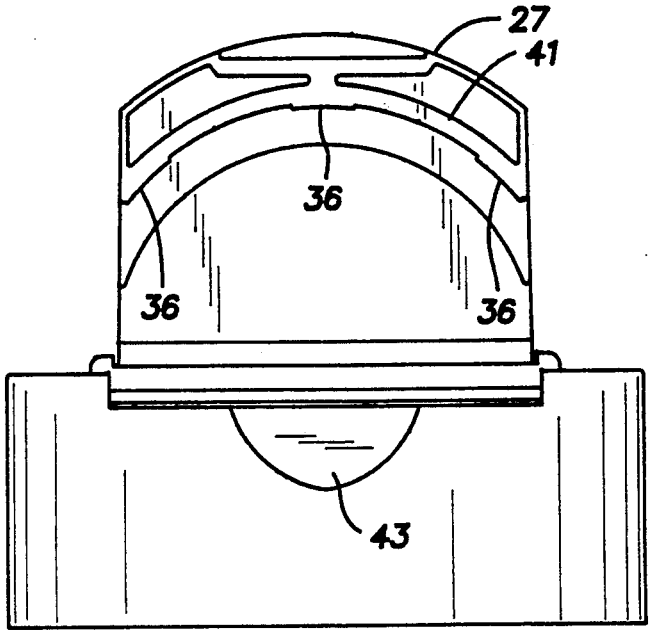
FIG. 3 is a side elevational view of the cap taken from the plane 3—3 indicated in FIG. 1.

As shown in FIGS. 1 and 2, the spoon dispensing opening or aperture 23 is relatively large with its dimensions, measured in the plane of end wall 15, generally at least an order of magnitude greater than the average wall thickness of the end wall and skirt 14.

Typically, the distortion experienced in the end wall 15 associated with the shake section 22, upon tightening of the cap 10 onto a container is less severe than the distortion experienced on the end wall along the spoon aperture 23 since there is substantial wall stock surrounding the shake apertures 46 which is available to support and reinforce the end wall area overlying the sealing surface or ledge 19 in the shake section 22. Consequently, the forces tending to pop open the shake flap 13 are less than those experienced by the spoon flap 13. It will be understood, however, that the shake flap catch 49 and end wall catch 51 function in essentially the same manner as that described in connection with the spoon flap 12.

It should be evident that this disclosure is by way of example and that various changes may be made by adding, modifying or eliminating details without departing from the fair scope of the teaching contained in this disclosure. For example, the cap may be provided with one or more than two flaps. The invention is therefore not limited to particular details of this disclosure except to the extent that the following claims are necessarily so limited.

I claim:

1. An injection molded thermoplastic screw-on dispensing cap for a container with a circular mouth and an externally threaded neck, the cap having a generally cylindrical internally threaded skirt adapted to be threaded onto the neck of the container, a generally circular end wall radially inward of the skirt, the end wall having at least one dispensing opening therethrough for dispensing granular or particulate products from the container, a flap, a living hinge on the end wall formed integrally with the flap supporting the flap for movement between a closed and an open position, the flap being relatively rigid in its construction apart from the hinge, catch means for releasably holding the flap in its closed position with a retaining force that is sufficiently low to be overcome with a finger force applied by a user, the hinge being arranged such that when the flap is held closed by the catch means the hinge is adapted to resist forces on the flap, generally in the plane of the flap and away from the hinge, substantially exclusively by tensile reaction forces therein, the end wall including an annular area radially within the skirt for applying a circumferentially continuous pressure on the mouth of the container, the dispensing opening being relatively large with a dimension in the plane of the end wall generally at least an order of magnitude greater than the average wall thickness of the end wall and skirt and being adjacent a portion of said annular area, the annular area tending to deform axially upwardly when the cap is tightened onto the container neck and tending to move the flap in a direction to open it, means associated with said catch means and effectively responsive to axial upward deformation of the annular area to maintain an adequate level of retaining force of said catch means and thereby reduce the risk that the flap will open when the cap is over-tightened on the container neck.

2. A cap as set forth in claim 1, wherein said responsive means includes a wall element that extends axially away from said annular area.

3. A cap as set forth in claim 2, wherein said wall element is spaced radially inwardly from said skirt.

4. A cap as set forth in claim 3, wherein said annular area has an inner perimeter and said wall element is situated on or adjacent said inner peripheral area.

5. An injection molded thermoplastic screw-on dispensing cap for a container with a circular mouth and an externally threaded neck, the cap having a body with a generally cylindrical internally threaded skirt adapted to be threaded onto the threaded neck of the container, and a generally circular end wall radially inward of the skirt, the end wall having at least one dispensing opening therethrough for dispensing granular or particulate products from the container, a flap, a living hinge on the end wall formed integrally with the flap supporting the flap for movement between a closed and an open position, the flap being relatively rigid in its construction apart from the hinge, catch means for releasably holding the flap in its closed position with a retaining force that is sufficiently low to be overcome with a finger force applied by a user, the hinge being arranged such that when the flap is held closed by the catch means the hinge is adapted to resist forces on the flap, generally in the plane of the flap and away form the hinge, substantially exclusively by tensile reaction forces therein, the end wall including an annular area radially within the skirt for applying a circumferentially continuous pressure on the mouth of the container, the dispensing opening being relatively large with a dimension in the plane of the end wall generally at least an order of magnitude greater than the average wall thickness of the end wall and skirt and being adjacent a portion of said annular area, the annular area tending to deform axially upwardly when the cap is tightened onto the container neck and tending to move the flap in a direction to open it, the catch means including surface areas on said body and said flap, the catch means surface areas on the body facing generally radially outwardly and the catch means surface areas on the flap facing generally radially inwardly, said catch means being effectively responsive to axial upward deformation of the annular area to maintain an adequate level of retaining force of said catch means and thereby reduce the risk that the flap will open when the cap is over-tightened on the threaded neck of the container.

6. A cap as set forth in claim 5, wherein said catch surfaces areas are disposed axially above said annular area.

7. An injection molded thermoplastic screw-on dispensing cap for a container with a circular mouth and an externally threaded neck, the cap having a generally cylindrical skirt formed with an internal thread with a minor radius and adapted to be threaded onto the neck of the container, a generally circular end wall radially inward of the skirt, the end wall having at least one relatively large dispensing opening therethrough for dispensing granular or particulate products from the container, the dispensing opening having a dimension in the plane of the end wall an order of magnitude larger than the average wall thickness of the skirt and end wall, a flap, a hinge on the end wall supporting the flap for movement between a closed and an open position, the flap being relatively unextensible in its construction, catch means for releasably holding the flap in its closed position with a retaining force that is sufficiently low to be overcome with a finger force applied by a user, the hinge and the flap being arranged such that when the flap is held closed by the catch means, the hinge is adapted to provide substantially the exclusive resistance to forces on the flap generally in the plane of the flap and away from the hinge, the end wall including a generally circumferentially continuous annular sealing area radially within the skirt for applying a circumferentially continuous pressure on the mouth of the container, the annular area tending to deform axially upwardly when the cap is tightened onto the container neck and applying a force on the flap which is in a direction to open the flap, the catch means including an interengaging surface structure on the end wall facing radially outwardly and a complimentary interengaging surface structure on the flap facing radially inwardly, the interengaging surface structure of the end wall overlying a zone that is radially inward of the minor radius of the thread, said interengaging surface structures mutually cooperating in a manner that is effectively responsive to axial upward deformation of the annular area to maintain a level of flap retaining force and thereby reduce the risk that the flap will open when the cap is over-tightened on the container neck.

8. An injection molded thermoplastic screw-on dispensing cap according to claim 7, wherein the interengaging surface structure of the end wall radially overlies the sealing area.

9. An injection molded thermoplastic screw-on dispensing cap according to claim 8, wherein the interengaging surface structure of the end wall radially overlies an area immediately adjacent the radially inward extent of the sealing area.

10. An injection molded thermoplastic screw-on dispensing cap according to claim 7, wherein the dispensing opening is a relatively large spoon opening and the interengaging surface structure of the end wall is adjacent the radially outward boundary of the spoon opening.

* * * * *